United States Patent [19]

Sanpei et al.

[11] 4,152,544

[45] May 1, 1979

[54] SPEAKER SUPPORTING DEVICE

[75] Inventors: Kikuhisa Sanpei, Kasuya; Ryoichi Sawaki, Hachioji, both of Japan

[73] Assignee: Olympus Optical Company Limited, Tokyo, Japan

[21] Appl. No.: 819,609

[22] Filed: Jul. 27, 1977

[30] Foreign Application Priority Data

Jul. 30, 1976 [JP] Japan ..... 51-102526

[51] Int. Cl.[2] ..... H04R 1/28

[52] U.S. Cl. ..... 179/146 R

[58] Field of Search ..... 179/146 R

[56] References Cited

U.S. PATENT DOCUMENTS

| | | | |
|---|---|---|---|
| 3,947,646 | 3/1976 | Saito | 179/146 R |
| 4,028,504 | 6/1977 | Massa | 179/146 R |

*Primary Examiner*—William C. Cooper

*Attorney, Agent, or Firm*—Toren, McGeady and Stanger

[57] ABSTRACT

A speaker supporting device used for radios or cassette tape recorders includes a cylindrical or annular elastic body for supporting a speaker on its inner peripheral surface, one open end of the elastic body is tightly secured to a baffle plate and other open end of the elastic body is tightly secured to the chassis of a casing.

4 Claims, 2 Drawing Figures

SPEAKER SUPPORTING DEVICE

BACKGROUND OF THE INVENTION

1. Field of the Invention

The present invention relates to a speaker supporting device used for radios, cassette tape recorders and the like, and particularly it relates to a speaker supporting device which does not spoil the tone quality effect.

2. Description of Prior Art

It is common to secure a speaker for a cassette radio or the like directly to a casing.

If the speaker is secured directly to the casing, however, vibration of the speaker is transmitted directly to the casing and the casing itself vibrates, so that the tone quality characteristic of the speaker is considerably deteriorated. A sound generated from the rear side of the speaker where a sound and a phase thereof generated from the speaker front are reversed usually turns to the speaker front, so that these sounds are compensated with each other, particularly energy of middle and low sounds is decreased and thus the tone quality characteristic of the speaker is terribly deteriorated from this point of view.

SUMMARY OF THE INVENTION

An object of the present invention is to eliminate the above described defects of the speaker.

Another object of the present invention is to provide a speaker supporting device for obtaining excellent tone quality characteristic from the speaker.

According to the present invention a speaker supporting device comprises a cylindrical or annular elastic body for supporting a speaker on its inner peripheral surface thereof, one open end of the elastic body is tightly secured to a baffle plate and other open end of the elastic body is tightly secured to the chassis of a casing. An annular groove is formed in the inner peripheral surface of the cylindrical elastic body and extends in the circumferential direction, and into this groove is inserted a flange portion of the speaker. A plurality of increased thickness portions are spaced apart along the circumferential direction of the elastic body, and these portions are fixed to the chassis by projections and fittings.

DESCRIPTION OF THE PREFERRED EMBODIMENT

Figure 1:
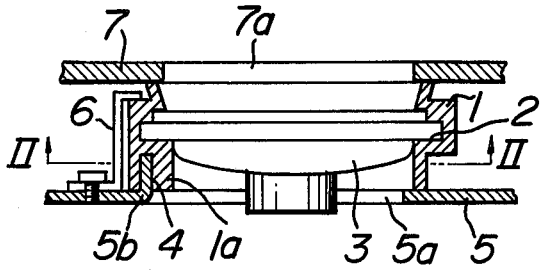
FIG. 1 is a cross-sectional view showing one embodiment of a speaker supporting device according to the present invention.
Figure 2:
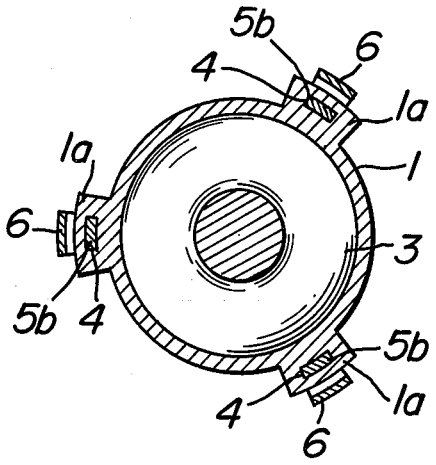
FIG. 2 is a bottom view taken in the direction of the arrows along the line II—II of FIG. 1.

Referring to FIGS. 1 and 2, reference numeral 1 is a cylindrical or annular elastic body for supporting a speaker 3, and the radially inner surface of this elastic body 1 is provided with a groove 2 extending in the circumferential direction and this part of the elastic body has a U-shaped configuration. Into this groove 2 is inserted a flange portion of a speaker 3 so as to support the speaker 3. Extending outwardly from the radially outer surface of the elastic body at the open end portion of the elastic body 1 located at a rear side of the speaker 3, there are a plurality of increased thickness portions 1*a* spaced apart in the circumferential direction, and a groove 4 is formed in the end surface of each portion 1*a*.

The open end of the elastic body 1 at the rear side of the speaker communicates with a speaker aperture 5*a* in a chassis 5. The chassis 5 forms a casing for housing components of an acoustic apparatus. Around the peripheral edge of the speaker aperture 5*a*, projections 5*b* are formed at the positions corresponding to the grooves 4 of the portions 1*a*, these projections 5*b* are inserted into the grooves 4, respectively, and the radially outer peripheral surface of the U-shape part of the elastic body 1 is engaged by a fitting 6 secured to the chassis 5, thereby tightly securing the elastic body 1 to the chassis 5.

The other open end of the elastic body located in front of the speaker 3, and is in communication with a speaker aperture 7*a* of a baffle plate 7. The baffle plate 7 is fixed to the chassis 5 at the portion which is not shown, but by this fixing, the baffle plate is tightly secured to the adjacent open end of the elastic body 1.

According to the construction as described above, the speaker is secured to the chassis through the elastic body, so that vibration of the speaker is absorbed by the elastic body and is not transmitted to the chassis, and thus the speaker can obtain an excellent tone quality characteristic. Further, the elastic body is tightly secured to the chassis and the baffle plate, respectively, at its open ends, so that sounds generated from the back of the speaker can be prevented from turning to the front, and thus tone quality characteristic of the speaker inclusive of low and middle sounds can be improved.

In addition, the present invention is not limited to the above embodiment but can be modified within the scope of the claim.

As described above, the present invention can provide a speaker supporting device for obtaining excellent tone quality.

What is claimed is:

1. A speaker supporting device comprising an axially extending annular elastic body having a radially inner peripheral surface and a radially outer peripheral surface, said elastic body having a first open end and a second open end spaced axially apart from said first open end and said open ends each forming an opening therein extending transversely of the axial direction of said elastic body, a baffle plate extending transversely of the axial direction of said elastic body and disposed in tightly fitting contact with said elastic body at the first end thereof, said baffle plate having an opening therethrough aligned with the opening formed by said first open end, and a casing chassis having a portion thereof extending transversely of the axial direction of said elastic body and located in tightly fitting engagement with said second open end of said elastic body, said portion of said casing chassis having an aperture therethrough aligned with the opening in said second end of said elastic body.

2. A speaker supporting device, as set forth in claim 1, including an annular groove formed in the inner peripheral surface of said elastic body for receiving an outwardly projecting flange on the circumferential peripheral surface of a speaker with the flange fitted into said annular groove.

3. A speaker supporting device, as set forth in claim 1, wherein a plurality of increased thickness portions project outwardly from the outer peripheral surface of said elastic body and said increased thickness portions are spaced angularly apart about said elastic body, each of said increased thickness portions having a groove therein in the surface thereof in the plane of the second end of said elastic body, and a plurality of projections on said chassis corresponding to the number of said increased thickness portions and each said projection arranged to fit into a different one of the grooves in said increased thickness portion.

4. A speaker supporting device, as set forth in claim 3, including a plurality of fittings secured to said casing chassis corresponding to the number of said projections thereon and each said fitting located adjacent a different one of said projections, said fitting shaped to interengage the outer peripheral surface of said elastic body for securing said elastic body to said casing chassis.

* * * * *